US005606403A

United States Patent [19]

Kikuchi et al.

[11] Patent Number: 5,606,403

[45] Date of Patent: Feb. 25, 1997

[54] TONER SUPPLY CONTROL SYSTEM FOR AN ELECTROPHOTOGRAPHIC APPARATUS

[75] Inventors: Toru Kikuchi; Shuho Yokokawa; Isao Watanabe; Satoshi Aita; Hidenori Takayasu; Shigeo Nemoto; Osamu Ohuchi; Kunitomo Takahashi; Youichi Takeuchi; Hidenori Iwanaga, all of Ibaraki, Japan

[73] Assignee: Hitachi Koki Co., Ltd., Tokyo, Japan

[21] Appl. No.: 558,769

[22] Filed: Nov. 15, 1995

[30] Foreign Application Priority Data

Dec. 5, 1994 [JP] Japan ..... 6-300796

[51] Int. Cl.[6] ..... G03G 21/00

[52] U.S. Cl. ..... 399/27; 399/53

[58] Field of Search ..... 355/208, 246, 355/260, 209; 118/688, 689, 690, 691, 692, 693, 694

[56] References Cited

U.S. PATENT DOCUMENTS

| | | | |
|---|---|---|---|
| 4,669,856 | 6/1987 | Yamada | 355/209 |
| 4,786,942 | 11/1988 | Kusumoto et al. | 118/688 X |
| 4,951,091 | 8/1990 | Nawata | 355/246 X |
| 4,987,449 | 1/1991 | Katoh | 118/688 X |
| 5,095,331 | 3/1992 | Takano | 355/246 X |
| 5,162,849 | 11/1992 | Yoshino et al. | 355/246 X |
| 5,359,396 | 10/1994 | Ogura et al. | 355/246 |
| 5,430,530 | 7/1995 | Ott et al. | 355/260 |

*Primary Examiner*—Shuk Yin Lee

*Attorney, Agent, or Firm*—Sughrue, Mion, Zinn, Macpeak & Seas

[57] ABSTRACT

A toner supply control system of the electrophotographic apparatus which includes a developing unit 3 for developing with a developer composed of toner and carrier; a toner hopper 4 for storing the toner; a toner empty sensor 7 for detecting the remainder of toner in the toner hopper 4; and a toner supply drive unit 5 for conveying toner from the outside of the apparatus into the toner hopper 4. Toner is conveyed from the outside into the toner hopper 4 by driving the toner supply drive unit 5 over a predetermined period of time without stopping the operation of the electrophotographic apparatus when the toner empty sensor 7 detects over a predetermined period of time that the remainder of toner in the toner hopper 4 is small. Then the existence of an output signal outputted from the toner empty sensor 7 indicating that the remainder of toner is small is detected, and a previous signal of toner shortage is output while the developing operation of the electrophotographic apparatus is being maintained in the case of existence of the output signal, and the shortage of toner is reported to an operator in accordance with the previous signal of toner shortage.

6 Claims, 7 Drawing Sheets

TONER SUPPLY CONTROL SYSTEM FOR AN ELECTROPHOTOGRAPHIC APPARATUS

BACKGROUND OF THE INVENTION

1. Field of the Invention

The present invention relates to a toner supply control mechanism of the electrophotographic apparatus, and more particularly relates to a toner supply control mechanism thereof.

2. Description of the Related Art

FIG. 8 is a schematic illustration showing an arrangement of the electrophotographic apparatus of the prior art, wherein the apparatus relating to toner supply and toner consumption is schematically illustrated in the drawing. The process will be explained as follows.

A toner bottle 2, which is a container charged with toner 1 functioning as powder ink, is attached to a toner supply port 3. Toner 1 is conveyed from the toner supply port 3 to a toner hopper 4 when a toner supply drive unit 5 is driven. Supply of toner from the outside of the apparatus into the toner hopper 4 will be referred to as toner supply, hereinafter. In this way, toner 1 is supplied from the outside into the apparatus. In general, toner supply indicates this operation.

When a toner supply switch 6 is pressed, the toner supply drive unit 5 is driven. When the toner supply switch 6 is pressed again during the driving operation, or alternatively when a predetermined period of time has passed, the driving operation of the toner supply drive unit 5 is stopped. The toner hopper 4 is a container in which toner 1 is stored. Inside the toner hopper 4, there is provided a toner empty sensor 7, and the shortage of toner 1 in the toner hopper 4 is detected by the toner empty sensor 7.

A toner feed drive unit 8 conveys toner 1 from the toner hopper 4 to a developing unit 9. Supply of toner from the toner hopper 4 to the developing unit 9 will be referred to as toner feed, hereinafter. Toner 1 and carrier 10, which is triboelectrically charged when it is rubbed against toner 1, are mixed with each other at a predetermined ratio, which will be referred to as a toner concentration, hereinafter. The thus obtained developer 11 is conveyed to a photoreceptor drum 12 by a development roller 13 mounted on the developing unit 9. In this way, an image on the photoreceptor drum 12 having photoconductivity is developed by toner 1. When the printing operation is conducted, toner 1 contained in developer 11 is consumed. In order to control the toner concentration to be constant, toner 1 stored in the toner hopper 4 is fed to the developing unit 9.

With reference to the timing chart shown in FIG. 7, toner supply conducted in the electrophotographic apparatus of the prior art will be described below.

When the toner empty sensor 23 detects the shortage of toner, a high level signal is outputted. In the case where the print signal 21 showing that the printing operation is being conducted is on a high level, a period of time in which the toner empty sensor signal 23 continues to be on a high level is measured by the control section. After a period of time of TO has passed, the control section judges that toner is in short supply, so that the toner shortage signal 24 becomes a high level. With this as a turning point, the printing operation is stopped and prohibited.

At this time, the print signal 21 for stopping the printing operation becomes a low level. The print prohibition signal 22 becomes a high level which shows that the printing is prohibited. At the same time, due to the high level of the toner shortage signal 24, toner shortage is reported to the outside. The operator receives the toner shortage signal 24 and attaches the toner bottle to the apparatus. Then the operator presses the toner supply switch, so that the signal becomes a high level. When the operator stops pressing the toner supply switch, the signal becomes a low level. When the toner supply switch signal 26 is turned from a high level to a low level, the toner supply signal 27 becomes a high level, and the toner supply is started. When a period of time S2 has passed from the start, the toner supply is stopped. Alternatively, when the toner supply switch is pressed, the toner supply can be stopped. When the toner shortage signal 24 showing that the toner is in short supply is on a high level, or alternatively, when the toner supply signal 27 showing that the toner is being supplied is on a high level, the print prohibition signal 22 becomes a high level, and the printing is prohibited.

When the toner is supplied, the toner empty sensor signal 23 becomes a low level. Together with the solution of toner shortage, the toner shortage signal 24 becomes a low level. After the completion of toner supply, the toner supply signal 27 becomes a low level. Then the print prohibition signal 22 becomes a low level, so that the printing is permitted. Since the operator recognizes that the printing has been permitted, he sets the print signal 21 at a high level so as to start the next printing operation.

Toner supply of the electrophotographic apparatus of the prior art described above is conducted by the operator when he has received the toner shortage signal. In order to extend a period in which the printing is stopped due to the shortage of toner, the operator supplies toner to the toner hopper as much as possible. The capacity of the toner hopper is several times as large as the capacity of the toner bottle. While toner is being supplied, or while toner is in short supply, in general, it is considered that the normal printing operation can not be conducted in that period. Therefore, it is common that the printing operation is prohibited in the specification of the apparatus. From the viewpoint of control, it is considered that toner can be supplied by the toner supplying mechanism of the prior art while the printing is being conducted. However, consumable goods are generally Supplied while the apparatus is not operated. Therefore, toner supply is prohibited during the printing operation.

In the electrophotographic apparatus of the prior art described above, only one toner shortage signal is used. In accordance with the toner shortage signal, information is reported to the outside of the apparatus, and the printing is stopped and prohibited. Printing is stopped due to the shortage of toner without a previous notice. Therefore, the printing efficiency is lowered when the printing operation is stopped and the apparatus is left as it is. In order to prevent the deterioration of the printing efficiency of the electrophotographic apparatus, it is necessary for the operator to watch the apparatus, which is a heavy burden on him.

The printing operation and toner supply are incompatible with each other. Therefore, only one of them can be carried out. For this reason, the operator must take care of the electrophotographic apparatus until the completion of toner supply at which the next printing can be started. Therefore, a heavy burden is imposed on the operator.

SUMMARY OF THE INVENTION

An object of the present invention is to provide a toner supply control system of the electrophotographic apparatus having a high handling property in which a burden imposed on the operator is reduced by avoiding the stoppage and prohibition of printing operation caused by the shortage of toner, and also toner can be smoothly supplied to the apparatus while the operator is not kept to the apparatus.

In order to accomplish the above object, the present invention is to provide an electrophotographic apparatus comprising: a developing unit for developing with a developer composed of toner and carrier; a toner hopper for storing the toner; a toner empty sensor for detecting the remainder of toner in the toner hopper; and a toner supply drive unit for conveying toner from the outside of the apparatus into the toner hopper.

Toner is conveyed from the outside into the toner hopper by driving the toner supply drive unit over a predetermined period of time without stopping the operation of the electrophotographic apparatus when the toner empty sensor detects over a predetermined period of time that the remainder of toner in the toner hopper is small, and then the existence of an output signal outputted from the toner empty sensor indicating that the remainder of toner is small is detected, and a previous signal of toner shortage is outputted while the operating condition of the electrophotographic apparatus is being held in the case of existence of the output signal, and the shortage of toner is previously reported to an operator in accordance with the previous signal of toner shortage.

According to the present invention, when the previous signal of toner shortage is outputted, stoppage of the printing operation caused by toner shortage can be prevented, so that a burden imposed on the operator can be reduced and further the printing efficiency can be enhanced.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Figure 1:
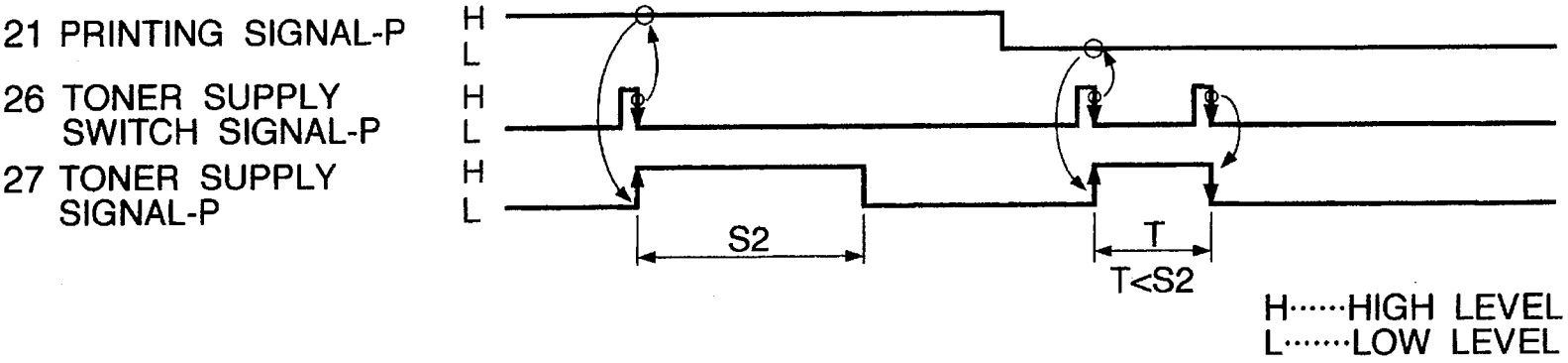
FIG. 1 as a timing chart for explaining the control of the present invention.
Figure 2:
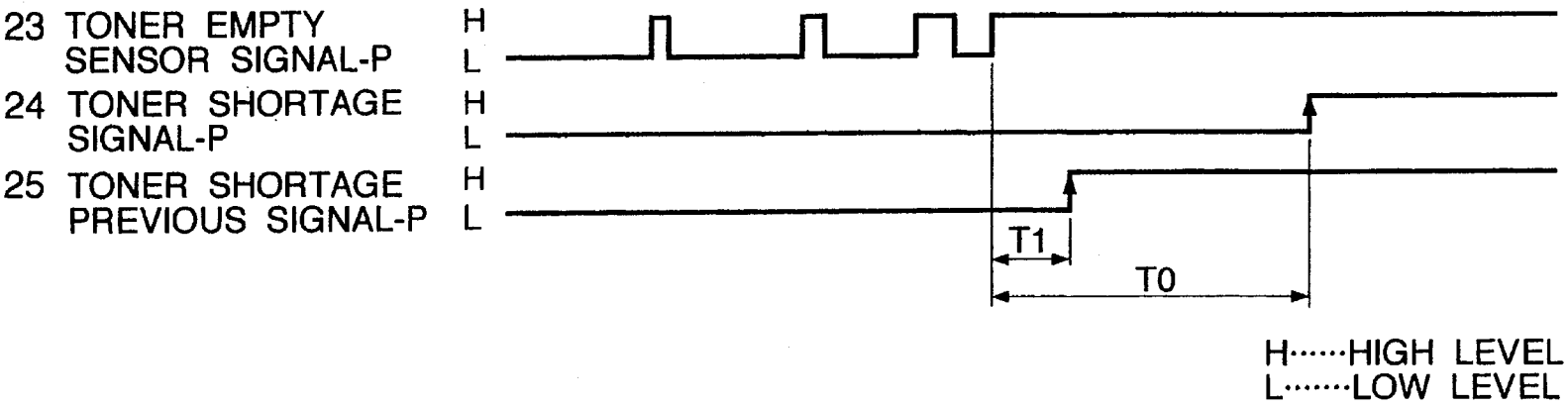
FIG. 2 as a timing chart for explaining the control of the present invention.
Figure 3:
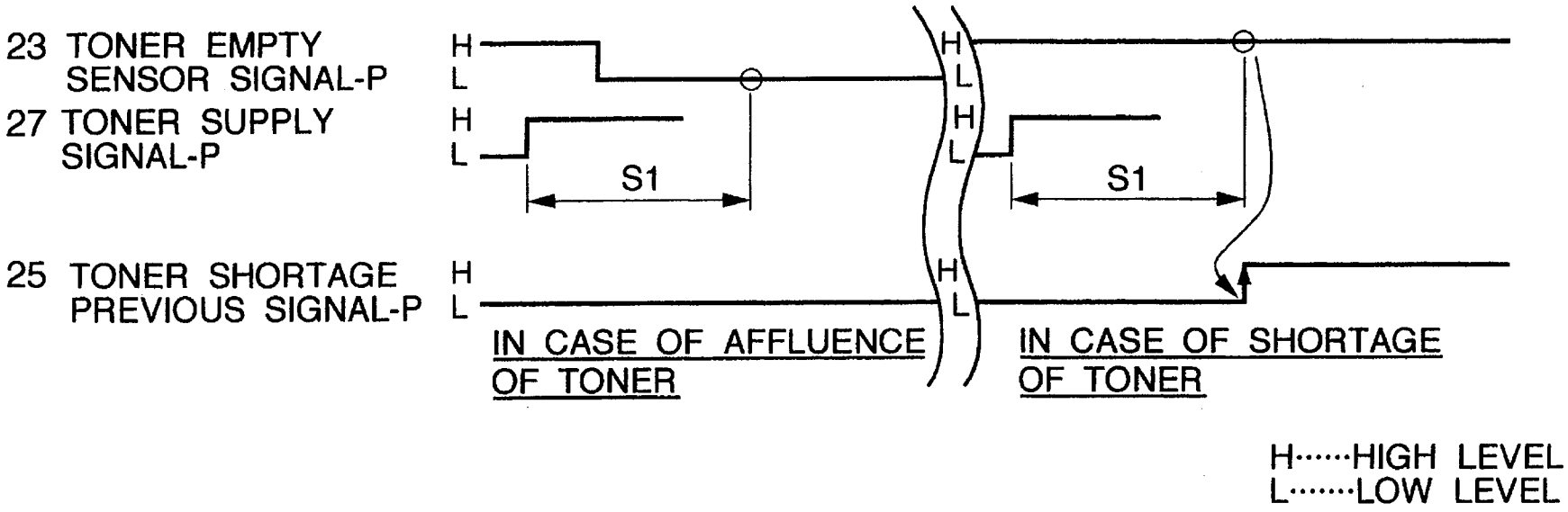
FIG. 3 as a timing chart for explaining the control of the present invention.

The arrangement of the embodiment of the present invention is the same as that of the prior art. Therefore, the explanation of the arrangement will be omitted here. With reference to FIG. 1, toner-supply control conducted in the printing will be explained. With reference to FIG. 2, detection control for detecting toner shortage stepwise will be explained. With reference to FIG. 3, judgment control for judging toner shortage in a predetermined period of time from the start of toner supply will be explained.

Toner supply control for supplying toner even while the electrophotographic apparatus is conducting the printing operation, which is one of the characteristics of the present invention, can be accomplished by changing the specification of the apparatus, although toner supply control can not be conducted in the apparatus of the prior art because of the specification of the apparatus.

Even when the printing signal 21 is on a high level which shows that the printing operation is being conducted, or even when the printing signal 21 is on a low level which shows that the printing operation is stopped, when the toner supply switch signal 26, which is on a high level when the toner supply switch is pressed and which is on a low level when the pressing of the toner supply switch is stopped, is turned from a high level to a low level, the toner supply signal 27 is made to be a high level, and the toner supply is started. Stoppage of toner supply is the same as that of the prior art, and after a period of time S2 has passed from the start of toner supply, the operation of toner supply is stopped. Alternatively, when the toner supply switch is pressed, the operation of toner supply is stopped (period T in the drawing).

Next, with reference to FIG. 2, detection control for detecting toner shortage stepwise from the output of the toner empty sensor, which is one of the characteristics of the present invention, will be explained below. In this case, toner shortage is judged as follows. When toner shortage is detected by the toner empty sensor signal 23, the high level, which shows toner shortage, and the low level, which shows toner affluence, are alternated, and when the high level is continued over a predetermined period of time, it is judged that toner is in short supply. Consequently, in order to detect the toner shortage stepwise, it is necessary that a period of time of the high level of the toner empty sensor signal 23 for judging a stepwise toner shortage is defined stepwise. In this way, the stepwise detection of toner shortage can be accomplished.

In this case, the shorter the period of time, in which the high level continues, is defined, the more beforehand the toner shortage is detected. However, from the viewpoint of prevention of malfunction of the sensor, it is not necessarily preferable to make the period to be short. It is possible to detect the toner shortage stepwise from a ratio of the high level to the low level in the hysteresis in a predetermined period of time in the past. Other methods of detecting toner shortage stepwise are described as follows. One method is based on the frequency of repetition of the high level in a predetermined period of time. Another method is based on an accumulated period of time of the high level. In any methods, the frequency of the high level of the toner empty sensor signal 23 in the process of toner consumption is an object of the definition. In this way, the toner shortage is defined stepwise.

This embodiment is based on the method in which the toner shortage is judged when the high level of the toner empty sensor signal 23 continues over a predetermined period of time. The toner shortage signal 24 to stop the printing operation is outputted when the high level continuation period has exceeded TO, and the previous signal of toner shortage 25 is outputted when the high level continuation period has exceeded T1. In this way, the two signals are reported. In this case, the relation between TO and T1 satisfies the inequality of TO>T1.

Next, with reference to FIG. 3, judgment control for judging toner shortage in a predetermined period of time from the start of toner supply, which is one of the characteristics of the present invention, will be explained below. After the toner supply signal 27 has been turned to a high level, the toner supply is started. When the period of time S1 has passed, the output condition of the toner empty sensor signal 23 is confirmed by the control section. When the output of the toner empty sensor signal 23 is on a low level, it is judged that toner is affluent, so that the previous signal of toner shortage is not activated. When the output of the toner empty sensor signal 23 is on a high level, it is judged that toner is in a short supply, so that the previous signal of toner shortage 25 is made to be a high level. Due to the above control, after the period of time S1 has passed from the start of toner supply, it is possible to judge the toner shortage.

As described above, it is possible to supply toner while the printing operation is being conducted, and the toner shortage is detected stepwise, and further the toner shortage is judged in a predetermined period of time after the start of toner supply. Due to the above control, the toner shortage previous signal report control, the automatic toner supply control, and the automatic toner supply check control, in which the above two control systems are utilized, can be accomplished.

Figure 4:
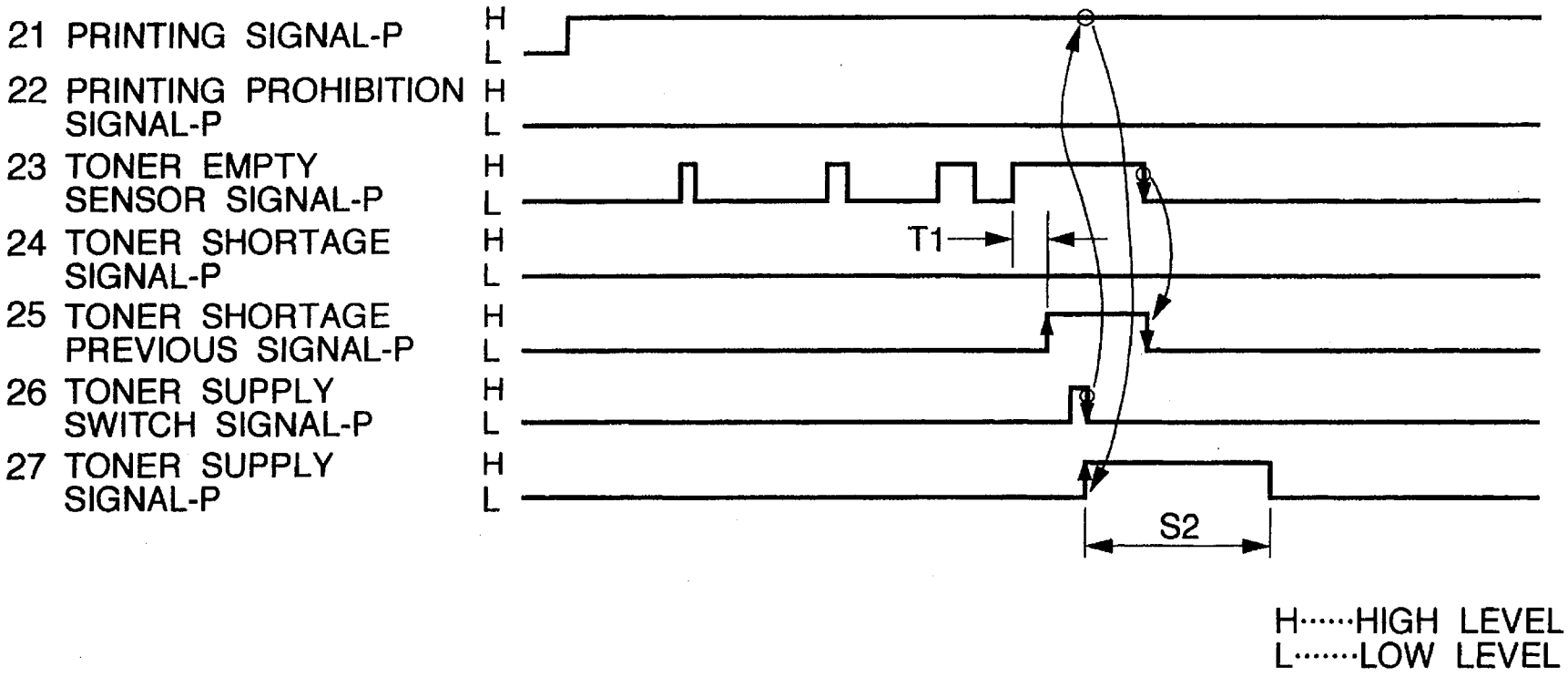
FIG. 4 as a timing chart for explaining the control of the present invention.
Figure 5:
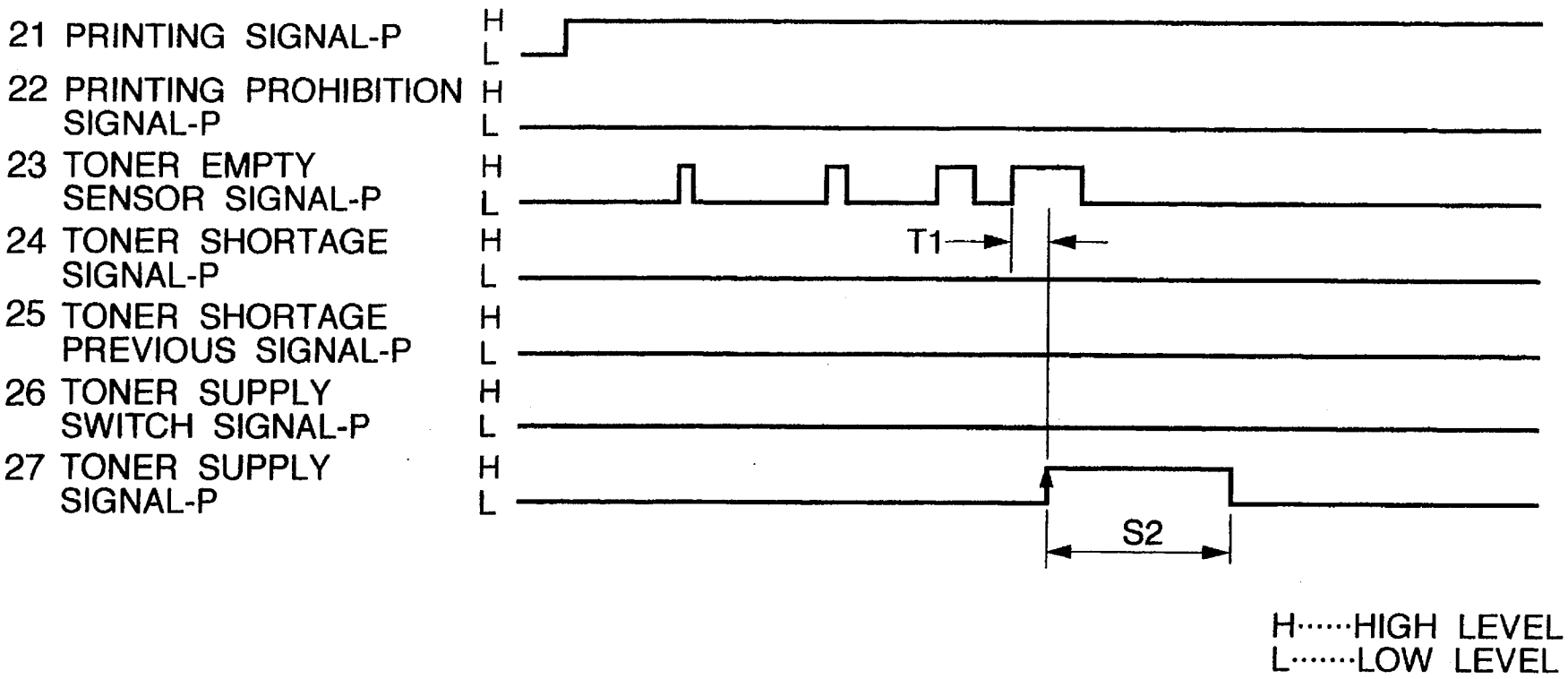
FIG. 5 as a timing chart for explaining the control of the present invention.
Figure 6:
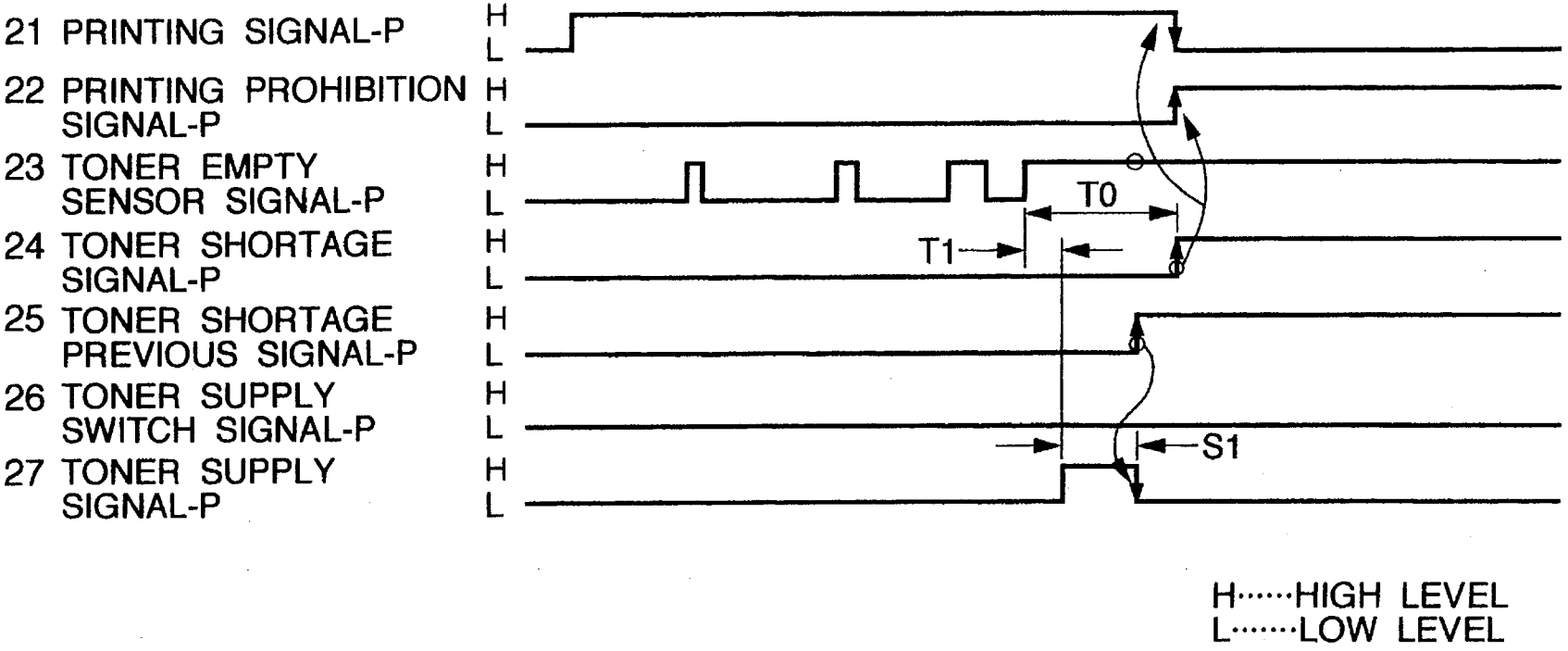
FIG. 6 as a timing chart for explaining the control of the present invention.
Figure 7:
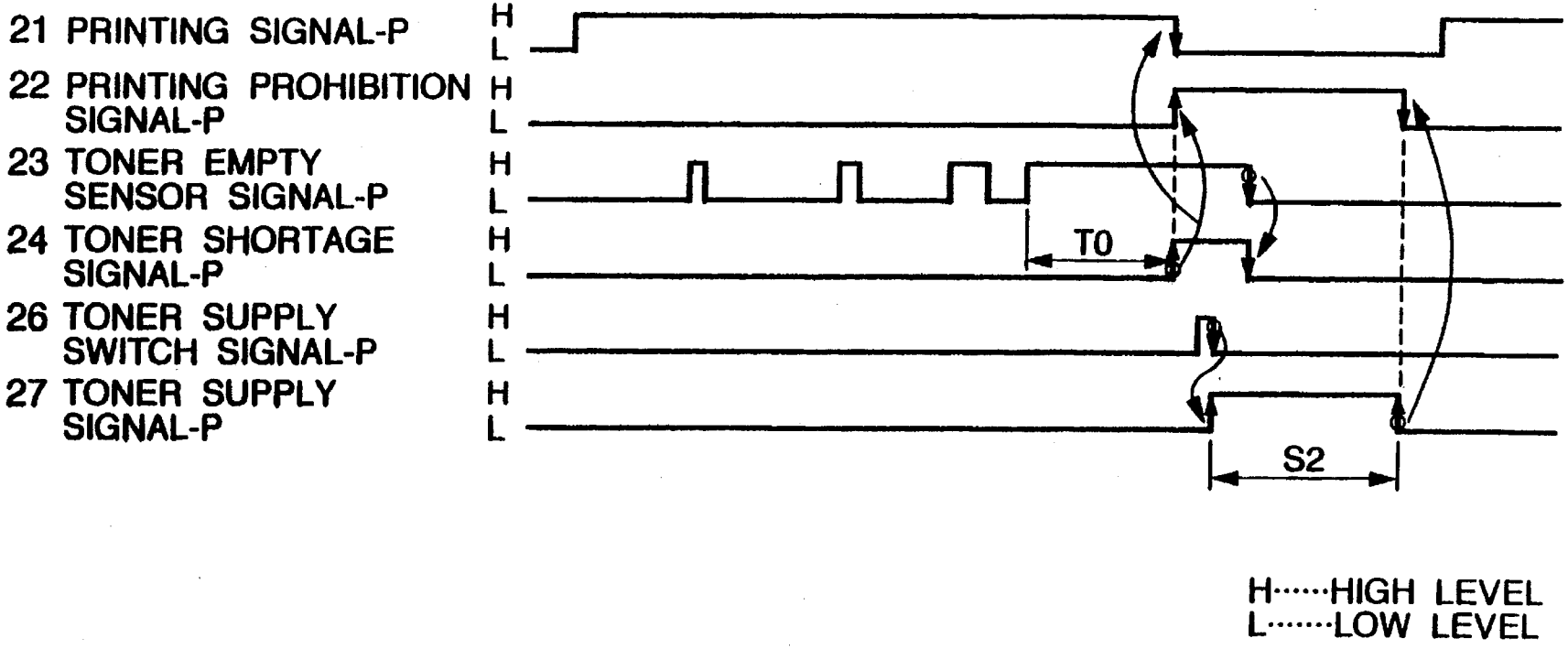
FIG. 7 PRIOR ART
FIG. 7 is a timing chart for explaining the toner supply of the prior art.
Figure 8:
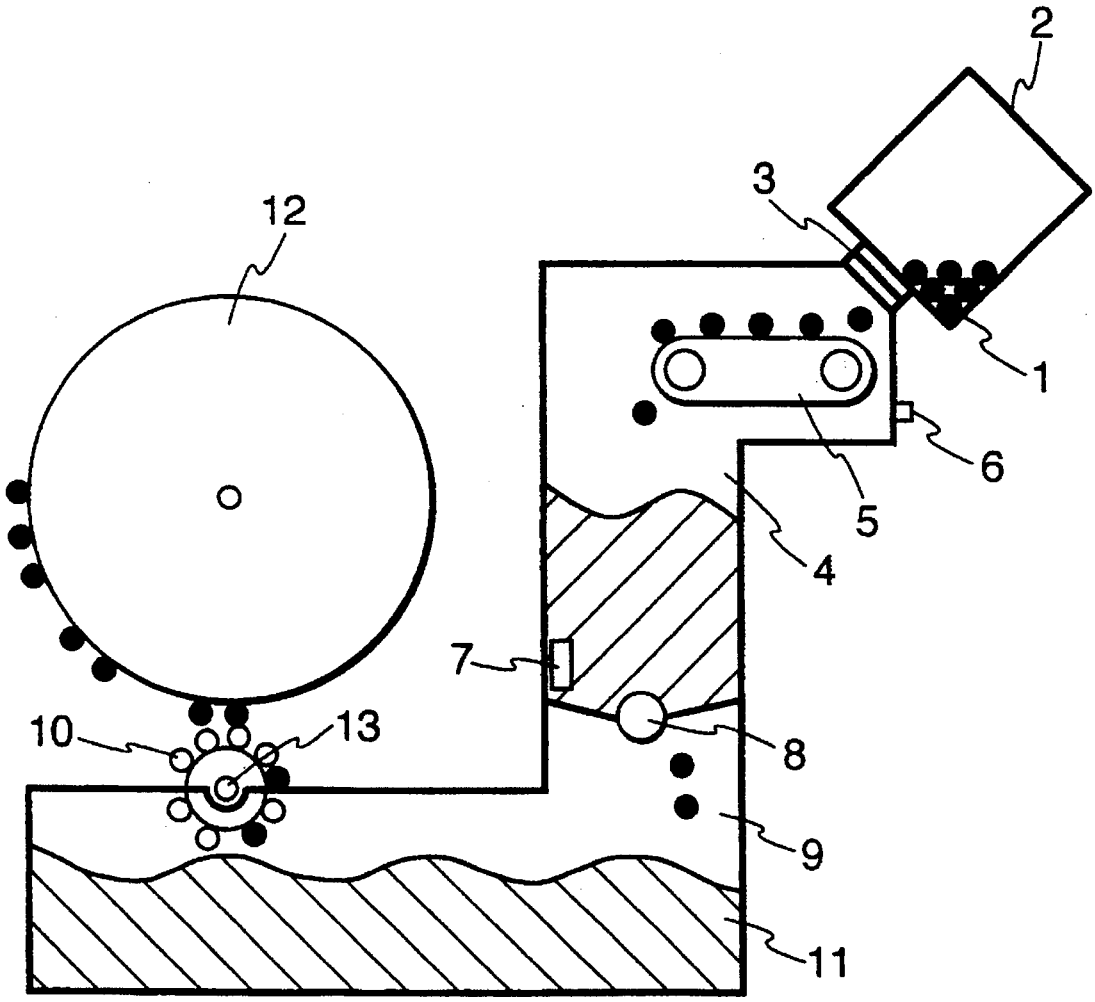
FIG. 8 PRIOR ART
FIG. 8 is a schematic illustration showing an outline of the arrangement of the electrophotographic apparatus.

With reference to FIGS. 4 to 6, the above control systems will be explained as follows.

With reference to FIG. 4, the toner shortage previous signal report control, which is one of the characteristics of the control system of the present invention, will be explained as follows. When the toner shortage is detected by the toner empty sensor signal 23, a high level is outputted. A period of time in which the toner empty sensor signal 23 continues to be on a high level in the case where the printing signal 21 is on a high level, is measured by the control section. After a period of time T1 has passed, the toner shortage previous signal 25 becomes a high level. Therefore, the toner shortage previous signal 25 is reported to the outside of the apparatus, for example, by a buzzer of a voice. At this time, the toner shortage signal 24 is maintained to be on a low level showing that toner is affluent. The operator receives the toner shortage previous signal 25 and recognizes that toner is in short supply. Therefore, the operator starts supplying toner.

When the toner bottle is attached to the apparatus and then the toner supply switch is pressed, the toner supply switch signal 26 becomes a high level, and when pressing the toner supply switch is stopped, the toner supply switch signal 26 becomes a low level. When the toner supply switch signal 26 is turned from the high level to the low level, the toner supply signal 27 becomes a high level even while the printing operation is being conducted, so that the toner supply is started. After toner has been supplied, the toner empty sensor signal 23 becomes a low level and the condition of toner shortage is released, and at the same time the toner shortage previous signal 25 becomes a low level. As described above, the stoppage and prohibition of printing caused by the toner shortage can be avoided.

Automatic toner supply control, which is one of the characteristics of the control system of the present invention, will be explained with reference to FIG. 5. When the toner empty sensor signal 23 detects a toner shortage, an output of high level is sent out. A period of time in which the toner empty sensor signal 23 continues to be on a high level in the case where the printing signal 21 is on a high level, is measured by the control section. When a period of time T1 has passed, toner supply is started, while the toner shortage signal 24, the toner shortage previous signal 25 and the toner supply switch signal 26 are maintained at a low level and the toner supply signal 27 is made to be on a high level. When the toner shortage is dissolved by supplying toner, the toner empty sensor signal 23 becomes a low level. In the manner described above, it is possible to avoid the stoppage and prohibition of printing operation caused by toner shortage.

In this embodiment, both the toner shortage previous report and the automatic toner supply are conducted at a point of time when the toner empty sensor signal 23 continues to be on a high level and a period of time T1 has passed. However, the automatic toner supply has a specific starting method, which functions as a changeover method. That is, when the automatic toner supply mode is started, the toner supply is started when the period of time T1 has passed. However, the toner shortage previous signal 25 is not reported to the outside of the apparatus and when the automatic toner supply mode is not started, the toner shortage previous signal 25 is reported to the outside of the apparatus. However, the toner supply is not started.

Supply check control for checking the automatic toner supply, which is one of the characteristics of the control system of the present invention, will be explained with reference to FIG. 6. When the toner empty sensor signal 23 detects the toner shortage, an output of high level is sent out. A period of time in which the toner empty sensor signal 23 continues to be a high level in the case where the printing signal 21 is on a high level, is measured by the control section. When a period of time T1 has passed, while the toner shortage signal 24, the toner shortage previous signal 25 and the toner supply switch signal 26 are maintained at a low level, the toner supply signal 27 is made to be on a high level, and toner supply is started.

When the toner empty sensor signal 23 is on a low level at a point of time when a period of time S1 has passed after the start of toner supply, and also when the toner shortage is dissolved, the toner supply is continued over a period of time S2. This corresponds to the automatic toner supply described above.

When the toner empty sensor signal 23 is on a high level so that the toner shortage is not dissolved at a point of time when the period of time S1 has passed from the start of toner supply, the toner shortage previous signal 25 is made to be on a high level, and at the same time, the toner supply signal 27 is made to be on a low level, so that the toner supply is stopped. In this case, T1 is defined as a period of time from the start of continuous output of the high level of the toner empty sensor signal 23 to the start of automatic toner supply, and S1 is defined as a period of time in which toner supply check is conducted. Further, TO is defined as a period of time from the start of continuous output of the high level of the toner empty sensor signal 23 to the report of the toner shortage signal 24, wherein the report is conducted to the outside of the apparatus. In this case, TO is longer than the total of T1 and S1, that is, the inequality $TO>T1+S1$ is satisfied. When toner supply is conducted in a period of time from the report of the toner shortage previous signal 25 to the report of the toner shortage signal 24, and also when the toner empty sensor signal 23 is made to be on a low level, it is possible to avoid the stoppage and prohibition of printing operation.

When the toner empty sensor signal 23 continues to be on a high level without conducting the toner supply, and also when the period of time TO has continuously passed after the start of output of the high level of the toner empty sensor signal 23, the toner shortage signal 24 becomes a high level, and the printing operation is stopped and prohibited.

According to the control system of the present invention, it is possible to avoid the stoppage of printing operation caused by the toner shortage when toner is automatically supplied or alternatively when the operator supplies toner in accordance with the previous report.

Even while toner is being supplied, it is possible to continue the printing operation. Therefore, the operator is not restricted to the apparatus to take care of it.

It is possible to prevent the stoppage of printing operation caused by toner shortage. Consequently, the printing efficiency can be enhanced.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner supply control device for use in a electrophotographic apparatus, said device comprising:

a developing unit for developing with a developer containing toner and carrier;

a toner hopper for storing the toner;

a toner empty sensor for detecting a remainder of toner in the toner hopper;

a toner supply drive unit for conveying toner from outside of said electrophotographic apparatus into said toner hopper; and control means for controlling said toner supply drive unit to be driven over a first predetermined period of time to convey toner from the outside into said toner hopper without stopping a developing operation of said electrophotographic apparatus after said toner empty sensor detects over a second predetermined period of time that the remainder of toner in said toner hopper is small, and then for detecting, after said first predetermined period of time, an existence of an output signal output from said toner empty sensor indicating that the remainder of toner is small, to output a previous signal of toner shortage while the developing operation of said electrophotographic apparatus is maintained during the existence of the output signal, and to report a shortage of toner to an operator according to the previous signal of toner shortage.

2. A method of controlling toner supply in an electrophotographic apparatus, including: a developing unit for developing with a developer including toner and carrier; a toner hopper for storing the toner; a toner empty sensor for detecting a remainder of toner in said toner hopper; and a toner supply drive unit for conveying toner from outside of said electrophotographic apparatus into said toner hopper, said method comprising the steps of:

conveying toner conveyed from the outside into said toner hopper by driving said toner supply drive unit over a first predetermined period of time without stopping a developing operation of said electrophotographic apparatus after said toner empty sensor detects over a second predetermined period of time that the remainder of toner in said toner hopper is small; and detecting, after said first predetermined period of time, the existence of an output signal output from the toner empty sensor indicating that the remainder of toner is small; and when existence of said output signal is detected during said detecting step, outputting a previous signal of toner shortage while the developing operation of said electrophotographic apparatus is being maintained, to report the shortage of toner to an operator according to the previous signal of toner shortage.

3. A toner supply control device as claimed in claim 1, wherein said control means prohibits the developing operation of said electrophotographic apparatus when a third predetermined period of time elapses after said shortage of toner is reported to said operator according to the previous signal of toner shortage and said toner empty sensor still detects that the remainder of toner in said toner hopper is small.

4. A method as claimed in claim 2, further comprising the step of prohibiting the developing operation of said electrophotographic apparatus when a third predetermined period of time elapses after said shortage of toner is reported to said operator according to the previous signal of toner shortage and said toner empty sensor still detects that the remainder of toner in said toner hopper is small.

5. A toner supply control device as claimed in claim 1, further comprising a toner feed drive for conveying said toner in said toner hopper to said developing unit.

6. A method as claimed in claim 2, further comprising a step of conveying said toner in said toner hopper to said developing unit.

* * * * *